US005656018A

United States Patent [19]

Tseng

[11] Patent Number: 5,656,018

[45] Date of Patent: Aug. 12, 1997

[54] HANDY VIBRATING MASSAGER

[76] Inventor: James Tseng, No. 396, Sec. 1, Min Sheng N. Rd., Taoyuan City, Taiwan

[21] Appl. No.: 706,516

[22] Filed: Sep. 4, 1996

[51] Int. Cl.[6] ..... A61H 15/00

[52] U.S. Cl. ..... 601/112; 601/113; 601/46; 601/84

[58] Field of Search ..... 601/112, 113, 601/46, 83, 84, 85

[56] References Cited

U.S. PATENT DOCUMENTS

| | | | |
|---|---|---|---|
| 1,631,792 | 6/1927 | Burnley | 601/112 |
| 2,519,790 | 8/1950 | Quinn | 601/112 |
| 2,670,733 | 3/1954 | Gordon | 601/112 |
| 3,095,874 | 7/1963 | Frajdenrajch | 601/112 |
| 3,096,757 | 7/1963 | Berard | 601/112 |

*Primary Examiner*—Robert A. Hafer
*Assistant Examiner*—Benjamin Koo
*Attorney, Agent, or Firm*—Morton J. Rosenberg; David I. Klein

[57] ABSTRACT

A handy vibrating massager which includes a casing holding a main motor in a motor mount thereof, a base coupled to the motor mount by flexible connecting members and having a center opening, compression springs respectively mounted around the flexible connecting members and retained between the motor mount and the base, a massaging wheel assembly coupled to the main motor and suspending in the center opening of the base and turned to rub against the body, miniature motors respectively mounted inside the base, and cams respectively turned by the miniature motors against the motor mount to impart a reciprocating motion to the base, causing the base to vibrate a part of the body to which the base is attached.

2 Claims, 4 Drawing Sheets

HANDY VIBRATING MASSAGER

BACKGROUND OF THE INVENTION

The present invention relates to handy vibrating massagers, and relates more particularly to such a handy vibrating massager which comprises a massaging wheel turned by a main motor to rub against the body, and a base with raised portions reciprocated by cams to vibrate the body.

Various massaging apparatus have been developed for massaging the body, and have appeared on the market. There is also known a handy vibrating massager which comprises a casing, a vibrating base coupled to the casing by springs and reciprocated by reciprocating mechanism to vibrate the body, and massaging wheel means mounted in the casing and forced out of an opening in the vibrating base and turned to rub against the body. This structure of handy vibrating massager has drawbacks. Because the vibrating base is coupled to the casing by springs, it tends to be oscillated in parallel to the body to lessen the transmission of reciprocating force from the reciprocating to the vibrating base. If the vibrating base is excessively oscillated, the springs may be jammed in the massaging wheel means, causing the massaging wheel means to be stuck.

SUMMARY OF THE INVENTION

The present invention has been accomplished to provide a handy vibrating massager which eliminates the aforesaid drawbacks. According to the preferred embodiment of the present invention, the handy vibrating massager comprises a casing defining a handhold portion, a motor chamber, and a bottom coupling groove; a motor mount fastened to the bottom coupling groove of the casing, having a bottom wheel chamber, an axle hole through the bottom wheel chamber, and four coupling portions respectively disposed in four corners thereof and defining a respective coupling through hole; a main motor mounted within the motor housing of the casing, having a reduction gear coupled thereto, the reduction gear having an output shaft inserted through the axle hole of the bottom wheel chamber of the motor mount; a massaging wheel assembly mounted within the bottom wheel chamber of the motor mount and coupled to the output shaft of the reduction gear, the massaging wheel assembly comprising a plurality of massaging wheels, and a soft covering covered over the massaging wheels; a base connected to the motor mount, comprising a circular center opening, which receives the massaging wheel assembly, a plurality of raised portions raised from a bottom side thereof and adapted for rubbing against the body, four pairs of stub posts respectively disposed in the four corners thereof, four locating plates respectively fastened to the four pairs of stub posts by respective screws and having a respective through hole respectively disposed in alignment with the coupling through holes of the motor mount; two miniature motors disposed mounted in the base at two opposite locations, having a respective output shaft and a respective cam fixedly mounted around the respective output shaft, the cam of each o miniature motor being turned against the motor mount to move the base forwards and backwards alternatively relative to the motor mount; four flexible connecting members connected between the motor mount and the locating plates of the base, each flexible connecting member having a first screw rod at one end inserted through the coupling through hole of one coupling portion of the motor mount and screwed up with one nut, and a second screw rod inserted through the through hole of one locating plate and screwed up with one nut; and four compression spring respectively mounted around the four flexible connecting members and retained between the motor mount and the locating plates of the base.

DETAILED DESCRIPTION OF THE PREFERRED EMBODIMENT

Figure 1:
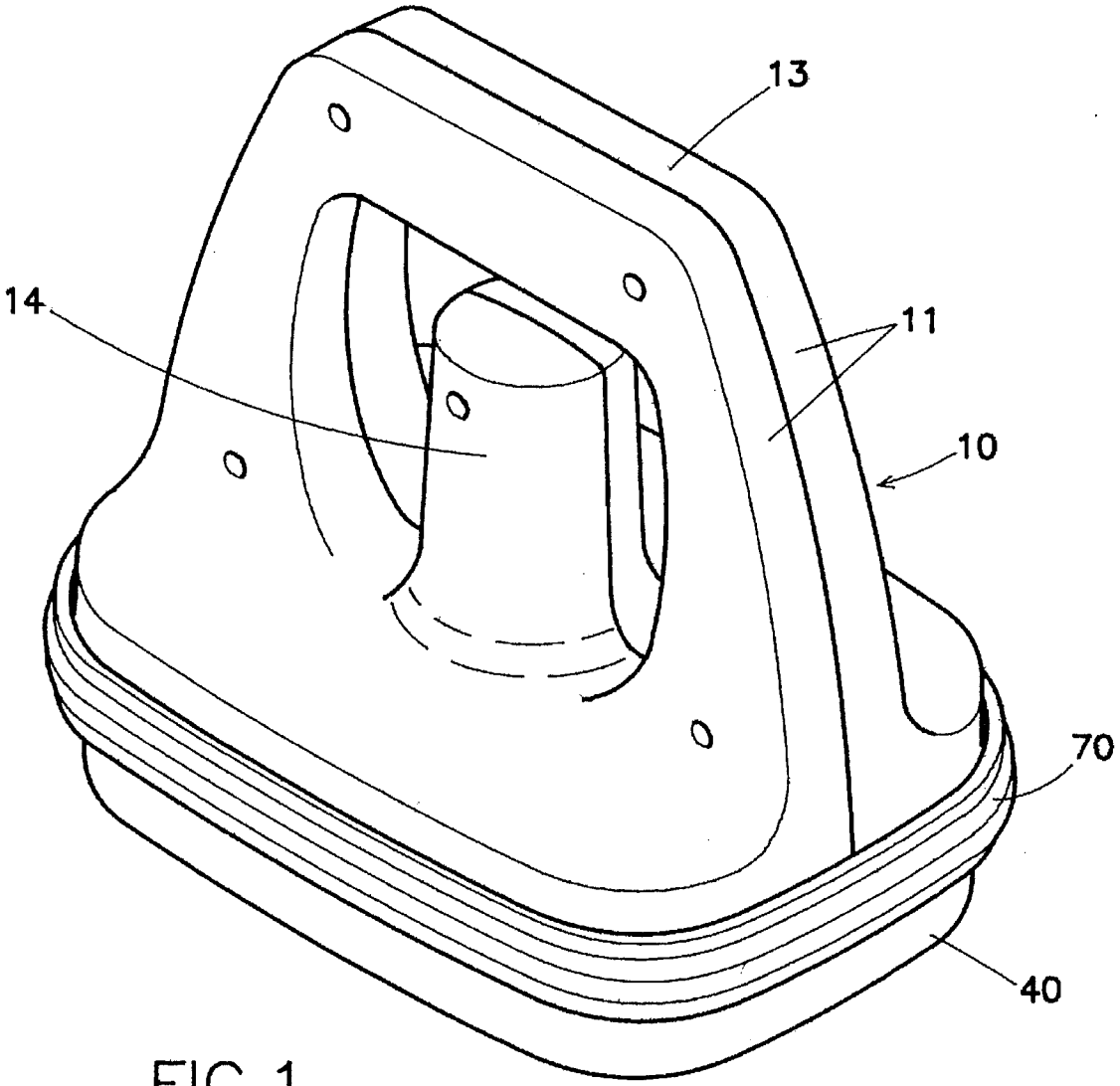
FIG. 1 is an elevational view of a handy vibrating massager according to the present invention.
Figure 2:
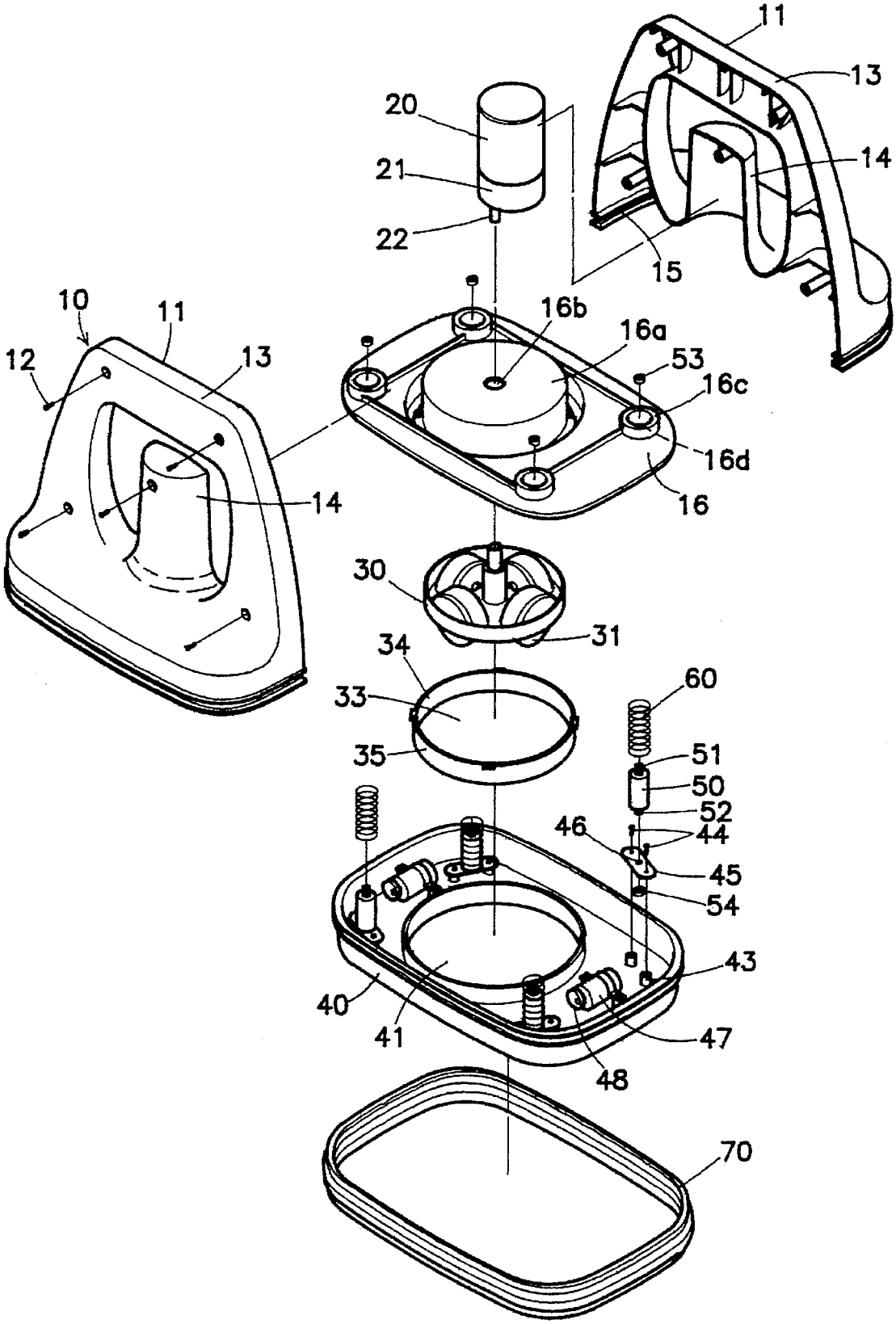
FIG. 2 is an exploded view of the handy vibrating massager shown in FIG. 1.
Figure 3:
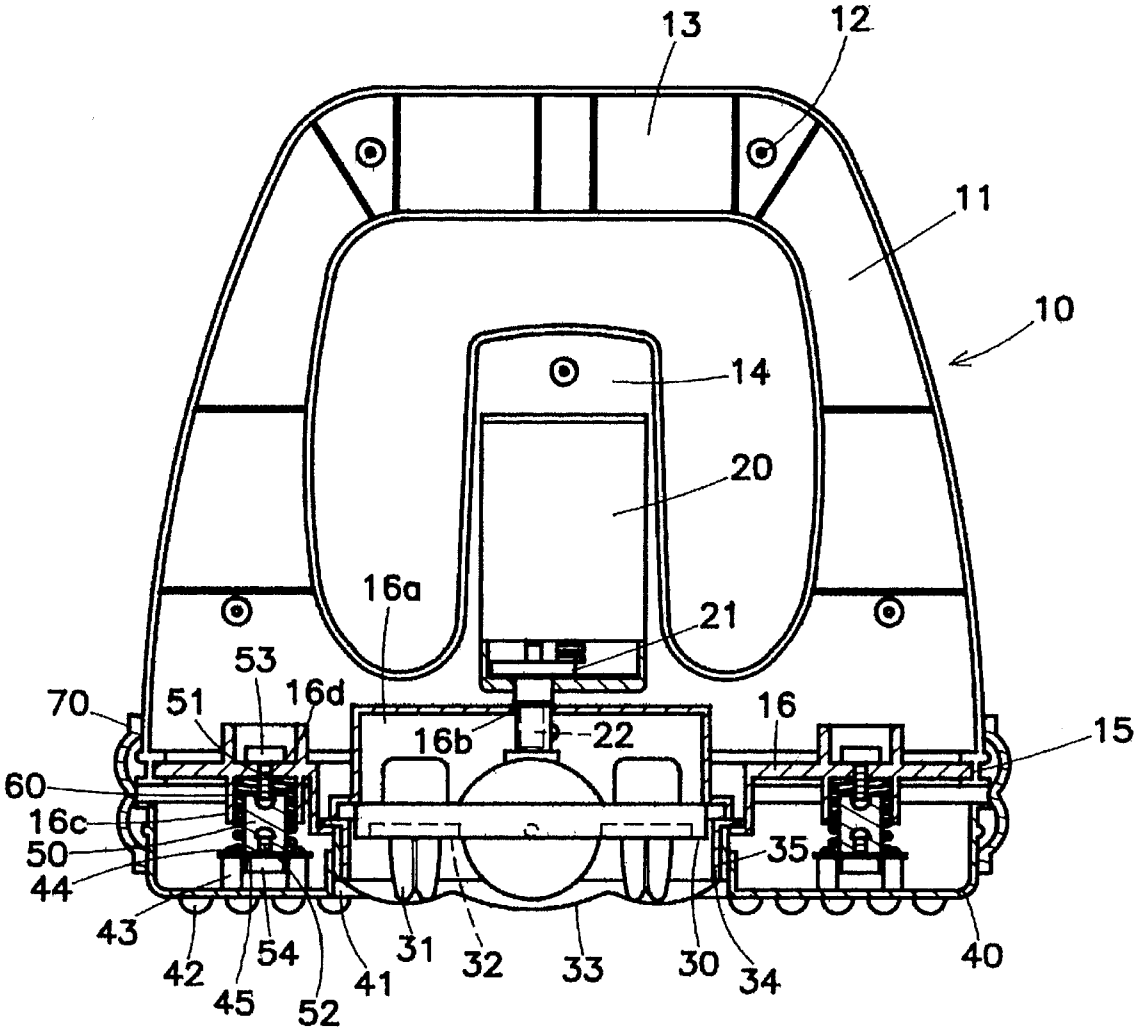
FIG. 3 is a sectional plain view of the handy vibrating massager shown in FIG. 1.

Referring to FIGS. from 1 to 3, a handy vibrating massager in accordance with the present invention is generally comprised of a casing 10, a main motor 20, a massaging wheel assembly 30, and a base 40.

The casing 10 is comprised of two symmetrical half shells 11 fastened together by screws 12, defining a handhold portion 13, a motor chamber 14, and a bottom coupling groove 15. A motor mount 16 is fastened to the bottom coupling groove 15 of the casing 10, comprising a bottom wheel chamber **16*a* adapted for receiving the massaging wheel 30, axle hole 16*b* through the center of the bottom wheel chamber 16*a*, and four coupling portions 16*c* respectively disposed in the four corners thereof and defining a respective coupling through hole 16*d***.

The main motor 20 is mounted within the motor housing 14 of the casing 10, having a reduction gear 21 coupled thereto. The reduction gear 21 has an output shaft 22 inserted through the axle hole **16*b* of the bottom wheel chamber 16*a* of the motor mount 16 into the inside of the bottom wheel chamber 16*a***.

The massaging wheel assembly 30 is mounted within the bottom wheel chamber **16*a* of the motor mount 16 and coupled to the output shaft 22 of the reduction gear 21, comprised of a plurality of radial axles 32, a plurality of massaging wheels 31 respectively turned around the axles 32, and a soft covering 33 covered over the massaging wheels 31 and secured to the periphery of the massaging wheel assembly 30 by mounting frames 34, 35**.

The base 40 is a hollow shell connected to the motor mount 16 by four connecting members 50, comprising a circular center opening 41 adapted for receiving the massaging wheel assembly 30, a plurality of raised portions 42 raised from the bottom side thereof around the center opening 41, four pairs of stub posts 43 respectively disposed in the four corners thereof, four locating plates 45 respectively fastened to the four pairs of stub posts 43 by respective screws 44 and having a respective through hole 46 respectively disposed in alignment with the coupling through holes **16*d* of the motor mount 16, two miniature motors 47 disposed at two opposite locations, and two cams 48 respectively coupled to the miniature motors 47. The connecting members 50 are made from flexible material for example rubber, having an embedded top screw rod 51 and an embedded bottom screw rod 52 at two opposite ends. The top screw rod 51 is inserted through the coupling through hole 16*d* of one coupling portion 16*c* of the motor mount 16 from the bottom, and secured in place by a nut 53. The bottom screw rod 52 is inserted through the through hole 46** of one locating plate 45 from the top, and secured in place by a nut 54. There are four compression springs 60 respectively mounted around the connecting members 50 and stopped between the motor mount 16 and the locating plates 45. Furthermore, a packing rubber 70 is mounted around the periphery of the casing 10 and the base 40.

Figure 4:
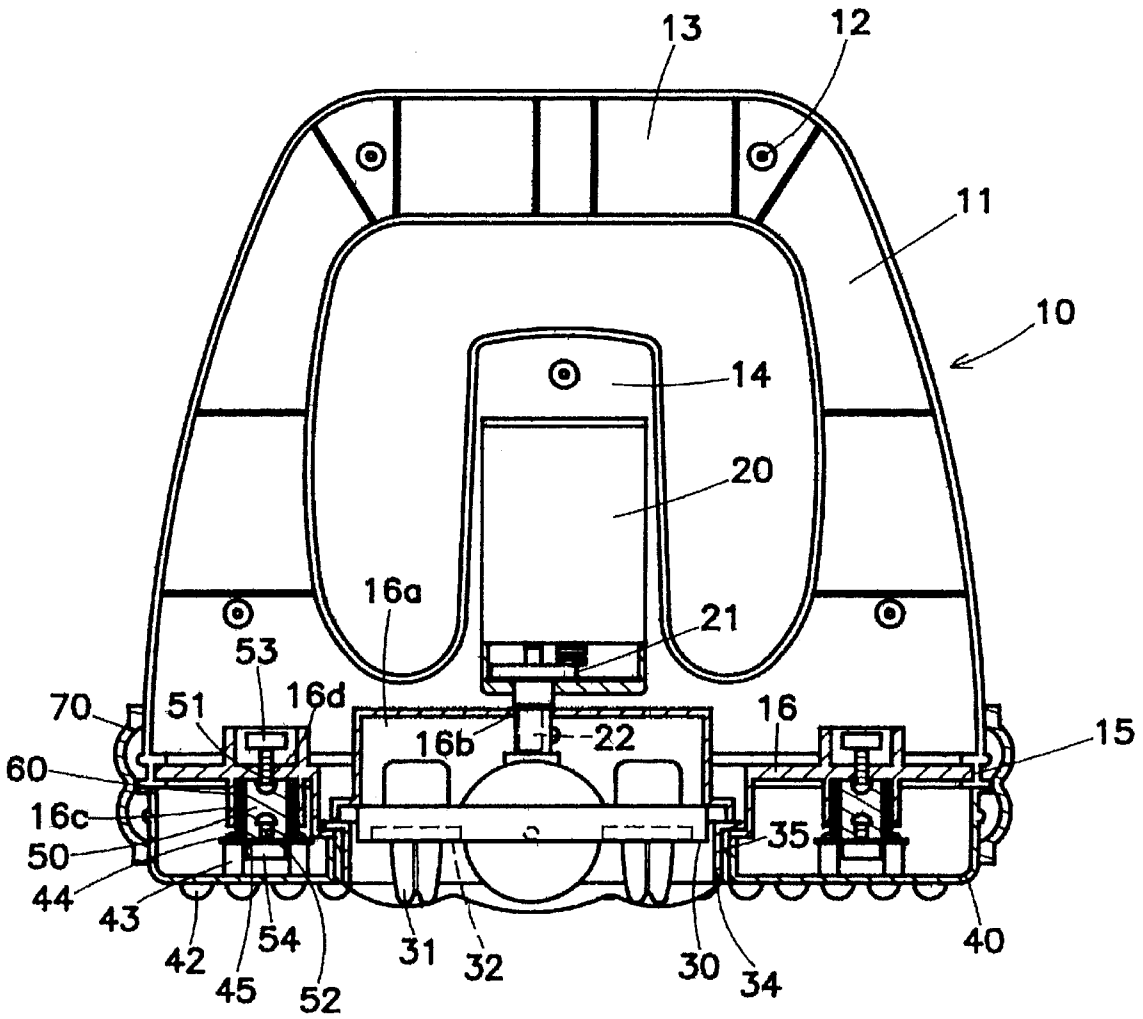
FIG. 4 is similar to FIG. 3 but showing the handy vibrating massager operated.

Referring to FIG. 4, when the main motor 20 and the miniature motors 47 are started, the massaging wheel assembly 30 and the cams 48 are respectively turned. As the base 40 is directly attached to a part of the body and the casing 10 is depressed, the compression springs 60 are compressed, and the wheels 31 are forced out of the circular center opening 41 of the base 40 and rubbed against the skin of the body, and at the same time, the cams 48 are turned by the miniature motors 47 to force the base 40 forwards and backwards alternatively, and therefore the body is massaged. When the base 40 of the handy vibrating massager is removed from the body, the springs 60 are released, and the base 40 is forced outwards from the motor mount 16, and therefore the massaging wheel assembly 30 is returned backwards into the inside the base 40.

As indicated, the base 40 is coupled to the motor mount 16 by the flexible connecting members 50, and the compression springs 60 are respectively mounted around the flexible connecting members 50 and retained between the base 40 and the motor mount 16, therefore the base 40 can be vibrated relative to the motor mount 16 and the casing 10.

While only one embodiment of the present invention has been shown and described, it will be understood that various modifications and changes could be made without departing from the spirit and scope of the invention disclosed.

What is claimed is:

1. A handy vibrating massager comprising:

a casing defining a handhold portion, a motor chamber, and a bottom coupling groove;

a motor mount fastened to the bottom coupling groove of said casing, said motor mount comprising a bottom wheel chamber, an axle hole through said bottom wheel chamber, and four coupling portions respectively disposed in four corners thereof and defining a respective coupling through hole;

a main motor mounted within the motor housing of said casing, having a reduction gear coupled thereto, said reduction gear having an output shaft inserted through the axle hole of the bottom wheel chamber of said motor mount;

a massaging wheel assembly mounted within the bottom wheel chamber of said motor mount and coupled to the output shaft of said reduction gear, said massaging wheel assembly comprising a plurality of massaging wheels, and a soft covering covered over said massaging wheels;

a base connected to said motor mount, said base comprising a circular center opening, which receives said massaging wheel assembly, a plurality of raised portions raised from a bottom side thereof and adapted for rubbing against the body, four pairs of stub posts respectively disposed in the four corners thereof, four locating plates respectively fastened to said four pairs of stub posts by respective screws and having a respective through hole respectively disposed in alignment with the coupling through holes of said motor mount;

two miniature motors disposed mounted in said base at two opposite locations, each of said miniature motors having an output shaft and a cam fixedly mounted around the output shaft, the cam of each of said miniature motors being turned against said motor mount to move said base forwards and backwards alternatively relative to said motor mount;

flexible connecting means connected between said motor mount and the locating plates of said base, said flexible connecting means comprising four flexible connecting members, and four nuts respectively fastened to said flexible connecting members to secure them between said motor mount and the locating plates of said base, each of said flexible connecting members having a first screw rod inserted through the coupling through hole of one coupling portion of said motor mount and screwed up with one nut, and a second screw rod inserted through the through hole of one locating plate and screwed up with one nut; and four spring means respectively mounted around said four flexible connecting members and retained between said motor mount and the locating plates of said base.

2. The handy vibrating massager of claim 1 wherein said casing is comprised of two symmetrical half shells fastened together.

* * * * *